US010803688B2

(12) United States Patent
McHale et al.

(10) Patent No.: US 10,803,688 B2
(45) Date of Patent: Oct. 13, 2020

(54) SYSTEM AND METHOD FOR STORAGE LOCKERS USING DIGITAL KEYS

(71) Applicant: Walmart Apollo, LLC, Bentonville, AR (US)

(72) Inventors: Brian McHale, Oldham (GB); John J. O'Brien, Farmington, AR (US); Robert Cantrell, Herndon, VA (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 16/260,792

(22) Filed: Jan. 29, 2019

(65) Prior Publication Data

US 2019/0236878 A1 Aug. 1, 2019

Related U.S. Application Data

(60) Provisional application No. 62/624,709, filed on Jan. 31, 2018.

(51) Int. Cl.
*G07C 9/00* (2020.01)
*G07C 9/28* (2020.01)

(52) U.S. Cl.
CPC ..... *G07C 9/00912* (2013.01); *G07C 9/28* (2020.01)

(58) Field of Classification Search
None
See application file for complete search history.

(56) References Cited

U.S. PATENT DOCUMENTS 6,456,900 B1 9/2002 Kakuta
6,791,450 B2 9/2004 Gokcebay et al.
6,882,269 B2 4/2005 Moreno
6,999,825 B2 2/2006 Inomata
10,341,310 B1 * 7/2019 Leon ..... H04L 9/00
2015/0007619 A1 1/2015 Finney et al.
2015/0332206 A1 11/2015 Trew et al.
2017/0073085 A1 3/2017 Tremblay et al.

(Continued)

FOREIGN PATENT DOCUMENTS

CN 203723697 U 7/2014
WO 2017091685 A1 6/2017

OTHER PUBLICATIONS

International Search Report and Written Opinion dated Mar. 27, 2019, issued in corresponding PCT Application No. PCT/US2019/015592.

(Continued)

*Primary Examiner* — Daniell L Negron

(74) *Attorney, Agent, or Firm* — Venable LLP; Jeffri A. Kaminski

(57) ABSTRACT

Systems, methods, and computer-readable storage media for receiving order information at a storage space, then generating single-use access information for opening the storage space to either deposit an item into, or retrieve an item from, the storage space. This single-use access information may be encoded into a token, then transmitted to a mobile device of the customer or courier. As the customer or courier crosses a geo-fence surrounding the storage space with the token, the mobile device transmits, to the storage space, a notification. This notification informs the storage space to transmit the single-use access instructions, allowing the courier or customer to deposit or remove a product as needed.

18 Claims, 5 Drawing Sheets

(56) References Cited

U.S. PATENT DOCUMENTS

| | | | | |
|---|---|---|---|---|
| 2017/0124510 | A1* | 5/2017 | Caterino | G06Q 10/083 |
| 2017/0147975 | A1 | 5/2017 | Natarajan et al. | |
| 2017/0203857 | A1 | 7/2017 | O'Toole | |
| 2017/0366547 | A1* | 12/2017 | Goldfarb | H04L 63/08 |

OTHER PUBLICATIONS

Tsunoru Nakashima, "Blockchain offers parcel companies escape from redelivery trap", Saison Information Systems, Nikkei Asian Review, Sep. 5, 2017, pp. 1-4.
Joe Ruether, "A Simple Bitcoin Analogy", Morning Musings, Apr. 26, 2015,pp. 1-5.

* cited by examiner

SYSTEM AND METHOD FOR STORAGE LOCKERS USING DIGITAL KEYS

PRIORITY

The present application claims priority to U.S. provisional patent 62/624,709, filed Jan. 31, 2018, the contents of which are incorporated herein.

BACKGROUND

1. Technical Field

The present disclosure relates to digital keys for storage lockers, and more specifically to using digital keys which are distributed upon entering a geo-fence.

2. Introduction

Storage lockers have long been used in public locations for temporary storage. Recently, as the growth of online sales has increased, customers can place an online order and have the item delivered to a storage locker until the customer can retrieve it. However, conveying access information to customers in a way that both allows the user to access the storage locker, while also preventing others from accessing those lockers, can be problematic.

Geofencing is the use of GPS (Global Positioning System) or RFID (Radio Frequency Identification) to create a virtual geographic boundary, such that when a mobile device enters or leaves a particular area it triggers a software enabled response. One common example of geofencing is when the keys to a car have an RFID, allowing the car doors to automatically unlock as the driver approaches the car. However, modifying a geo-fence to accommodate different items, different locations, and/or different people, all while preventing a storage locker from being inappropriately accessed, is a distinct technical problem than that of unlocking doors while approaching a car.

SUMMARY

An exemplary method of performing concepts as disclosed herein can include: receiving, at a processor associated with a storage space, order information from a remote computing device; generating, via the processor and based on the order information, single-use access information for opening the storage space to perform an action, the action comprising one of depositing of an item associated with the order information into the storage space and retrieving the item associated with the order information from the storage space; encoding the single-use access information into a token, the token having a layer of encryption; transmitting a location of the storage space to a mobile device associated with performance of the action; identifying a geo-fence area surrounding the storage space; receiving, from the mobile device, a notification that the mobile device has entered the geo-fence area; transmitting, in response to receiving the notification, the token to the mobile device; after transmitting the token, receiving the single-use access information; and providing access to the storage space based on receiving the single-use access information.

An exemplary storage space (such as a storage locker) configured according to this disclosure can include: a processor; and a computer-readable storage medium having instructions stored which, when executed by the processor, cause the processor to perform operations comprising: receiving order information from a remote computing device; generating, based on the order information, single-use access information for opening the storage space to perform an action, the action comprising one of depositing of an item associated with the order information into the storage space and retrieving the item associated with the order information from the storage space; encoding the single-use access information into a token, the token having a layer of encryption; transmitting a location of the storage space to a mobile device associated with performance of the action; identifying a geo-fence area surrounding the storage space; receiving, from the mobile device, a notification that the mobile device has entered the geo-fence area; transmitting, in response to receiving the notification, the token to the mobile device; after transmitting the token, receiving the single-use access information; and providing access to the storage space based on receiving the single-use access information.

An exemplary non-transitory computer-readable storage medium configured according to this disclosure can have instructions stored which, when executed by a computing device, cause the computing device to perform operations which include: receiving order information from a remote computing device; generating, based on the order information, single-use access information for opening the storage space to perform an action, the action comprising one of depositing of an item associated with the order information into the storage space and retrieving the item associated with the order information from the storage space; encoding the single-use access information into a token, the token having a layer of encryption; transmitting a location of the storage space to a mobile device associated with performance of the action; identifying a geo-fence area surrounding the storage space; receiving, from the mobile device, a notification that the mobile device has entered the geo-fence area; transmitting, in response to receiving the notification, the token to the mobile device; after transmitting the token, receiving the single-use access information; and providing access to the storage space based on receiving the single-use access information.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

DETAILED DESCRIPTION

Figure 1:
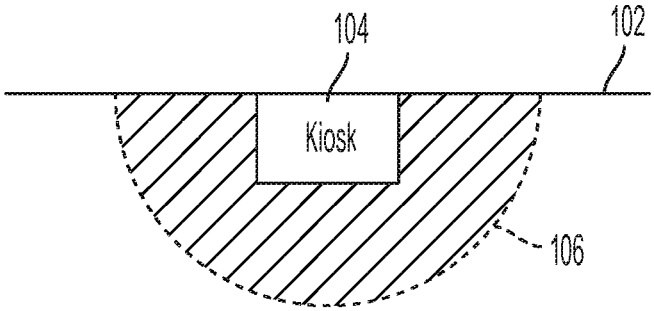
FIG. 1 illustrates an exemplary kiosk with a geo-fence.

Various embodiments of the disclosure are described in detail below. While specific implementations are described, it should be understood that this is done for illustration purposes only. Other components and configurations may be used without parting from the spirit and scope of the disclosure.

As items are dropped off or picked up at kiosks, storage lockers, secured mail boxes, or other storage spaces, a need exists to ensure that only authorized people are accessing the storage space. For example, in the case of depositing items into an empty storage unit, it may be desirable that only an authorized courier be able to access a storage locker to deposit items, thereby preventing the deposit of otherwise unwanted items. Likewise, in the case of retrieving items from a storage unit, it may be desirable that only an authorized recipient be able to access the storage unit, thereby preventing potential theft of the items. Storage spaces (such as storage lockers, kiosks, mail boxes, etc.) configured according to this disclosure can have built in processors which generate time-sensitive access information, as well as communication equipment for transmitting that time-sensitive access information to the courier/customer authorized to access the storage space.

In one example, a server or other computing system can receive an order from a customer for a product. The server can identify the product's current storage location and generate a work order instructing a courier to transfer the product from a current location to a storage locker geographically close to the customer. The server can then transmit the order and courier information to the storage locker. The storage locker can then generate single-use access information which will allow the courier to open the storage locker and place the product inside.

However, in this example, rather than immediately transmitting that single-use access information to the courier, the storage locker instead transmits location information about where the storage locker is located to a mobile device associated with the courier (such as a MC40, a smartphone, a tablet, a smartwatch, etc.). The identification of the mobile device, and how to contact it, may be provided to the storage locker from the server or another database. In some cases, the location information of the storage locker may provide identifying information about the storage locker (e.g., locker #502, 503, etc.), whereas in other cases that information may not be provided—only the location information. As the courier arrives at the location with their mobile device the courier crosses a geo-fence around the storage locker. Crossing the geo-fence with the mobile device triggers the mobile device to transmit a notification of its location to the storage locker. The location of the mobile device can be determined using GPS, triangulation, or any other location systems.

The storage locker, upon receiving the notification, transmits the single-use access information to the courier's mobile device. For example, in some configurations, this single-use access information can be in the form of a token which is transferred to the mobile device. The single-use access information can include the locker number or other identifying information, as well as instructions, codes, or other information necessary for the courier to access the storage locker. For example, the single-use access information may be "Locker 344A, combination is 5-12-13." As another example, the single-use access information may be "Locker 572, please take a photograph of the code displayed on the front of the locker and transmit that photograph to access the locker." Yet another example of single-use access information may require biometric data (fingerprint, retinal scan, etc.) from the courier prior to providing access. In such an example, the mobile device may record the biometric data, then transmit that data to the locker or the server, which can then verify and/or authorize access to the locker. In yet another example, the single use access information may be a notification that "the lock on locker 234 will now be disabled for 2 minutes."

In cases where the courier is delivering multiple packages to multiple lockers co-located within a geo-fence, the courier may be provided the option of selecting a single package for delivery from among multiple packages. If there is a time limit to how long the courier can access the storage locker, such an option provides the courier sufficient time for each individual package.

Communicating the single-use access information from the storage locker to the mobile device can take place using communications systems such as cellular telecommunications, satellite communications, etc. Preferably, however, near-field communications are used, where the signal attenuates to unusable levels after only a short distance (1-2 yards or meters).

The courier delivering the products can be a human courier or a robotic courier, such as a drone, automated vehicle, or other computer-enabled delivery system. A drone delivery system can have, for example, information about the delivery to be made such as the location where the product should be delivered. As the drone crosses the geo-fence of the storage space, the drone can trigger the storage space to transmit the token or other access information. The drone can then access the storage space according to the instructions received, deposit the product, close the storage space, and proceed to the next delivery. For human couriers, the process can be identical, with the difference being that information/tokens are transmitted to and from the courier's mobile device.

In some configurations, the single-access information can be encrypted. One exemplary of encryption and verification can be a blockchain. Each transaction in the blockchain can be anonymously verified by multiple computers, providing security against manipulation of the data. For example, the server, upon receiving the order information, can verify aspects of the order against data contained in the blockchain. The server can then forward the order information to the storage locker, which can encode the single-use access information into a new block. The new block can be transmitted to the other computers in a distributed computing network. These other computers can verify the block as accurate, add the new block to the blockchain, and/or distribute an updated blockchain containing the block.

The products or items being stored in the storage space may use RFID or other near-field communication mechanisms to track when products are put into the storage space and/or removed from the storage space. For example, an RFID may identify a box of cereal being delivered by a courier. As the courier places the box of cereal into the storage space, the RFID of the cereal box is detected by the processor associated with the storage space. The storage space can then generate additional data which is transmitted to the server, transmitted to the courier's mobile device, and/or retained by the storage space. This additional data can be, for example, a confirmation of delivery within the storage space.

When a customer or recipient goes to retrieve a product from a storage location, the same principles discussed with respect to a courier delivering an item to a storage location can apply to an acquisition from that storage location. For example, a storage locker may transmit location information to the recipient's mobile device, then only transmit access information upon the mobile device crossing a geo-fence. This access information may be a locker number, password, alphanumeric combination, electronic code, instructions to perform an action, captcha, and/or other request for data. In many cases, the delivery of this information can be further protected using encryption systems, blockchains, etc. As the product is removed from the storage locker, confirmation of the product's removal can be further verified based on movement associated with an RFID on the product. Customers or recipients may include both humans using a mobile device or drones.

Having discussed overall principles, the disclosure now turns to the specific examples illustrated in the figures. While exemplary configurations and embodiments are provided, individual parts, pieces, and processes from these examples may be used, removed, or exchanged as needed by a particular circumstance.

FIG. 1 illustrates an exemplary kiosk with a geo-fence. In this example, a wall 102 has a connected kiosk 104 which can hold goods prior to sale or pickup. In one example, the kiosk 104 may hold products ordered by customers prior to pick up. In another example, the kiosk 104 may be a private mailbox. In yet another example, the kiosk 104 may be a vending machine or other device constructed for immediate selection and delivery of goods. This kiosk 104 can define a geo-fence 106 around the kiosk 104 which extends a pre-determined distance from the kiosk 104. As illustrated, the geo-fence 106 ends at the wall 102, but may, in some configurations, extend through the wall 102. In addition, the geo-fence 106 as illustrated is circular, extending in a half-circle centered at the kiosk 104 with a constant radius. However, in other configurations, the geo-fence may be in other shapes (such as a rectangular or other parallelogram shape), and/or may not be centered on the kiosk 104.

In addition, while the geo-fence 106 is pre-determined prior to providing access to a courier or customer, the geo-fence 106 may vary in shape or area from iteration to iteration. For example, in a first instant, when a courier is depositing the package, the kiosk 104 may set the geo-fence 106 to extend in a rectangle 10 meters to the left and five meters to the right of the kiosk 104. However, the kiosk 104 may then set a subsequent geo-fence 106 to a semi-circle of 1 meter, centered on the kiosk 104, when the customer comes to retrieve the package. Determination for how to set the geo-fence 106 can be made based on the type of package being deposited/retrieved, the time of day, a history with a particular courier/customer, frequency of hacking/spoofing attempts, etc.

Figure 2:
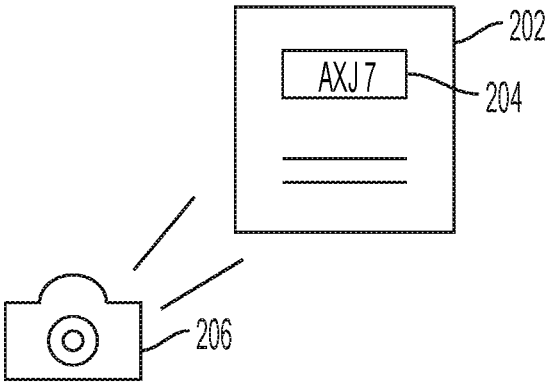
FIG. 2 illustrates a storage locker with a variable display being photographed.

FIG. 2 illustrates a storage locker with a variable display being photographed. In this example, the single-use access instructions provided to the courier/customer upon entering a geo-fence, contained instructions to take a photograph of the front of a storage locker 202. Specifically, the instructions want the courier/customer to take a photograph of a changing code 204 displayed on the face of the storage locker 202. The user photographs 206 the storage locker 202 and the changing code 204, then uploads that photograph to the storage locker 202 using information provided in the single-use access information. The storage locker 202 process then determines if the (1) picture of the storage locker (ignoring the code) represents the storage locker compared to photographs previously taken (and stored in a database); (2) if the picture of the code correctly matches the code which was being presented.

The changing code may vary periodically (e.g., every thirty seconds, every minute), or may be presented with a new code, for a limited period of time, each time the courier/customer triggers the geo-fence. Non-limiting, exemplary ways in which the code may change are alphanumeric values, colors, shapes, cursive writing, pictures, etc.

Figure 3:
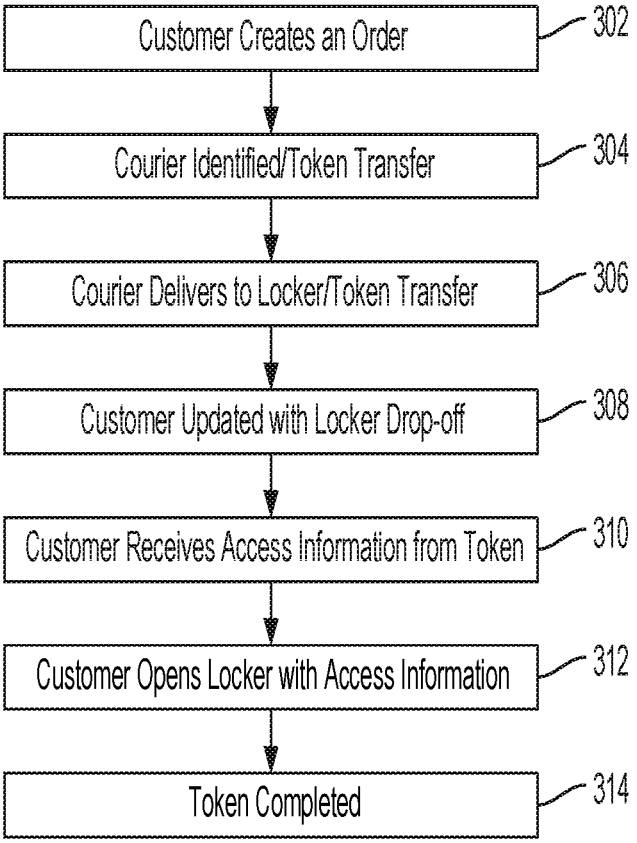
FIG. 3 illustrates an exemplary process flowchart.

FIG. 3 illustrates an exemplary process flowchart. In this example, the customer creates an order (302). In some instances this can be an online order, whereas in other cases the order may be placed at a retail location but scheduled for later delivery. A courier is identified and the token is delivered to the courier (304), or more precisely, the token is delivered to a mobile device associated with the courier. The courier delivers to the locker and the token is transferred (306) from the courier to either the locker or another computing system. The customer is then updated with locker drop-off information (308), and the customer receives access information from the token (310). The customer arrives at the locker and opens the locker with the access information (312). At this point, the token is completed (314).

Figure 4A:
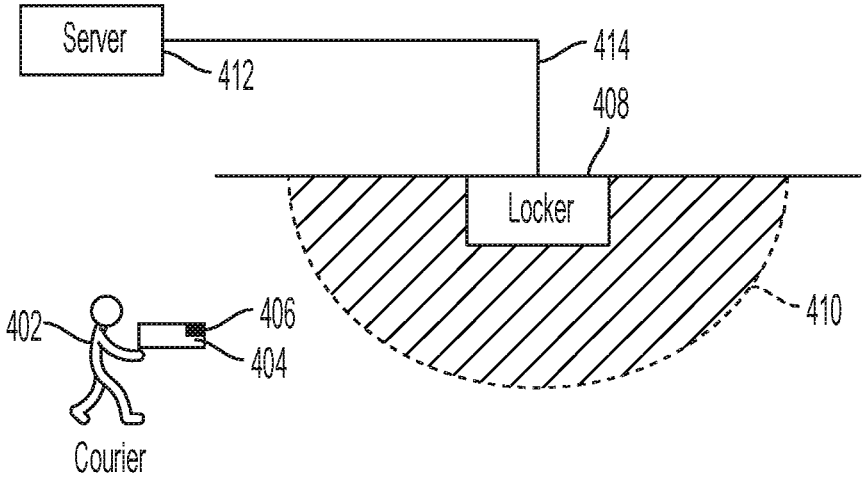
FIG. 4*a* illustrates an exemplary locker receiving an item from a courier.

FIG. 4*a* illustrates an exemplary locker 408 receiving an item 404 from a courier 402. In this example, the locker 408 is connected via a network cable 414 (or other wired communication cable) to a server 412. In other configurations, communications between the locker 408 and other computing systems (such as the server 408) may be performed via wireless communications. The server 412 can provide the locker 408 with information about couriers, customers, products, delivery times, anticipated retrieval times, tokens, blockchain records, etc. In this case, the server 412 has provided information to the locker 408 about the courier 402 and the package 404 the courier 402 is to place inside the locker 408. The courier's mobile device has been provided information about the locker, its locations, etc., either from the locker itself or from the central controller. Thus, the locker and the courier's device know they are looking for each other. As the courier 402 crosses the geo-fence 410, the locker receives a notification from the mobile device of the courier 402, alerting the locker 408 that the courier has arrived at the designated location. The locker 408 provides access information to the courier 402, allowing the courier 402 to place the package 404 inside the locker 408. As the courier 402 places the package 404 into the locker 408, an RFID tag 406 on the package 404 communicates the package 404 identification to the locker 408, allowing the locker 408 to confirm that the product received is the product anticipated.

Figure 4B:
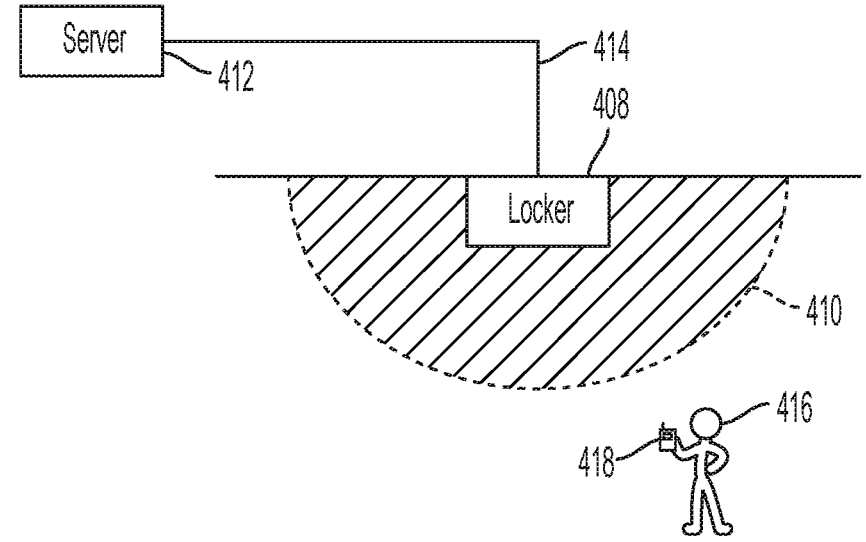
FIG. 4*b* illustrates an exemplary locker being accessed by a customer.

FIG. 4*b* illustrates the exemplary locker 408 being accessed by a customer 416. As the customer 416, and the customer's mobile device 418, cross the geo-fence 410, the locker provides the access information to the customer 416. The customer 416 can then retrieve the product from the locker 408.

Figure 5:
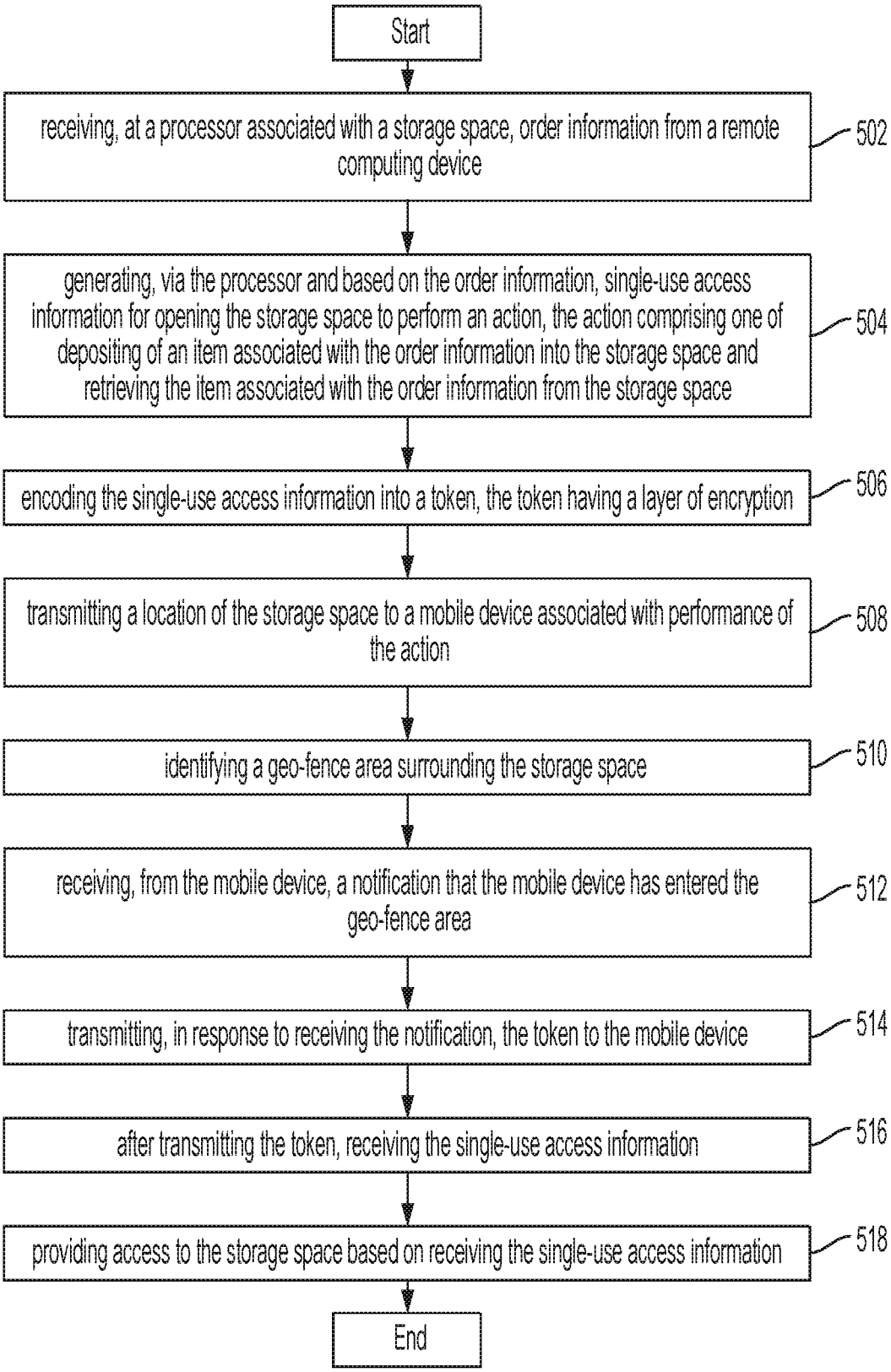
FIG. 5 illustrates an example method embodiment.

FIG. 5 illustrates an example method embodiment which can be performed according to the concepts disclosed herein. In this example, a processor associated with a storage space receives order information from a remote computing device (502). The processor generates, based on the order information, single-use access information for opening the storage space to perform an action, the action comprising one of depositing of an item associated with the order information into the storage space and retrieving the item associated with the order information from the storage space (504). The processor encodes the single-use access information into a token, the token having a layer of encryption (506) and transmits a location of the storage space to a mobile device associated with performance of the action (508). For example, the location is transmitted to the courier's mobile device, or the mobile device of the customer retrieving the item.

The processor also identifies a geo-fence area surrounding the storage space (510) and receives, from the mobile device, a notification that the mobile device has entered the geo-fence area (512). The processor transmits, in response to receiving the notification, the token to the mobile device (514). After transmitting the token, the processor receives the single-use access information (516) and provides access to the storage space based on receiving the single-use access information (518).

The action may be performed by an automated vehicle (such as a drone, robot, etc.), where the mobile device is a component of the automated vehicle. Alternatively, the action may be performed by a human being, where the mobile device is associated with the human being (such as a cell phone, smart phone, tablet, smart watch, key fob (or other keychain item), etc.).

In some configurations, the layer of encryption can include encoding the single-use access information into a block associated with a blockchain, and transmitting the block to a distributing computing system which: (1) verifies the block as valid, (2) adds the block to the blockchain, and (3) distributes an updated blockchain containing the block throughout the distributed computing system.

The method may further include receiving a photograph of an exterior of the storage space from the mobile device prior to the transmitting of the token. This can be done according to the single-use access information provided to either the courier or the customer. In addition, this photograph can be of a time-sensitive randomized code displayed on the exterior of the storage space.

In some configurations, the receiving of the notification that the mobile device has entered the geo-fence area is performed using a near-field communication system (e.g., communications which attenuate to unusable levels after a short distance, such as 1-2 meters). Likewise, in some configurations, the notification that the mobile device has entered the geo-fence area comprises Global Positioning System coordinates of the mobile device.

The method may also further include identifying an identification of the item based on a Radio Frequency Identification tag associated with the item. In such configurations, when the action (associated with the item) is performed, movement of the Radio Frequency Identification tag associated with the item may be registered with the processor.

Figure 6:
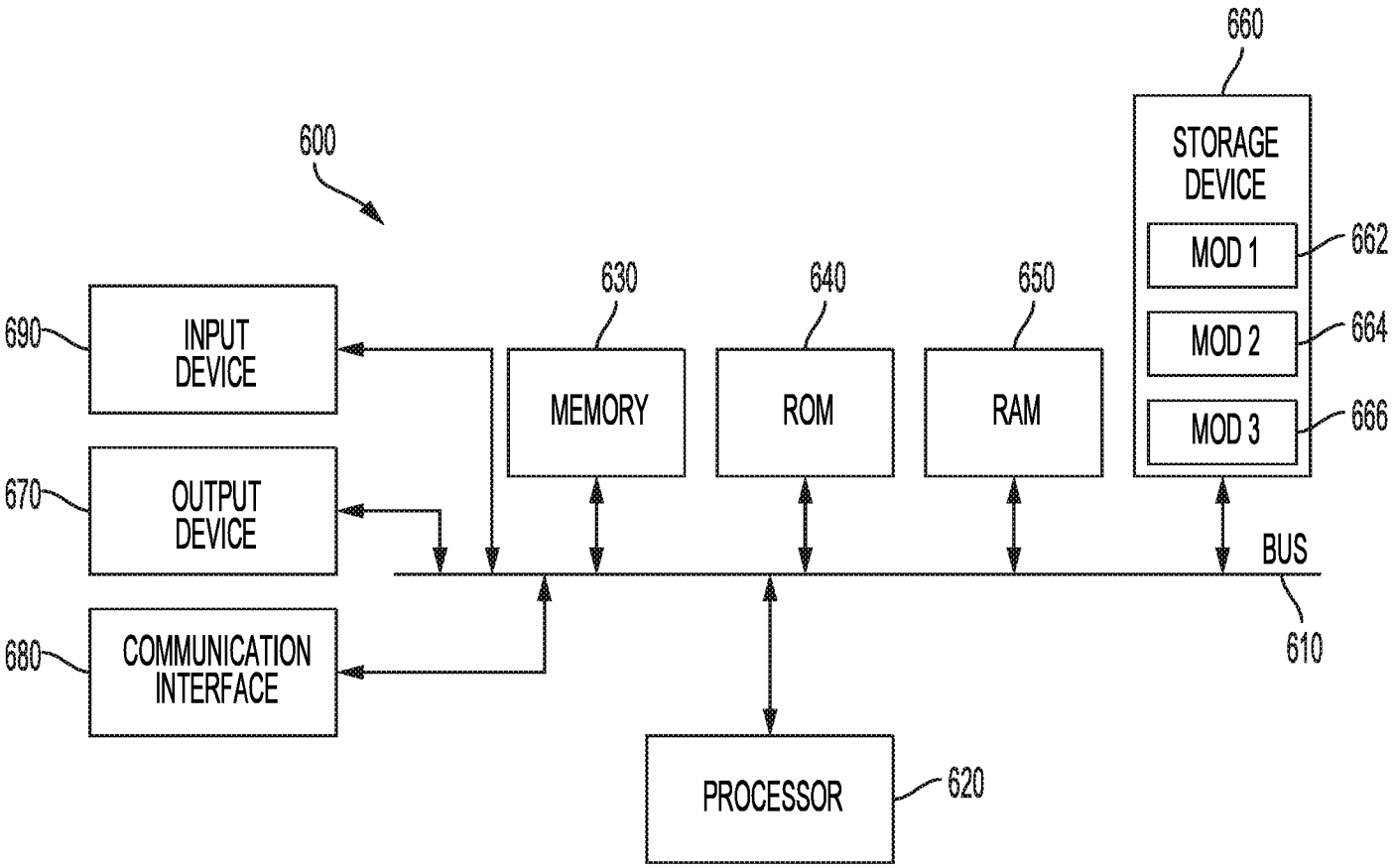
FIG. 6 illustrates an example computer system.

With reference to FIG. 6, an exemplary system includes a general-purpose computing device 600, including a processing unit (CPU or processor) 620 and a system bus 610 that couples various system components including the system memory 630 such as read-only memory (ROM) 640 and random access memory (RAM) 650 to the processor 620. The system 600 can include a cache of high-speed memory connected directly with, in close proximity to, or integrated as part of the processor 620. The system 600 copies data from the memory 630 and/or the storage device 660 to the cache for quick access by the processor 620. In this way, the cache provides a performance boost that avoids processor 620 delays while waiting for data. These and other modules can control or be configured to control the processor 620 to perform various actions. Other system memory 630 may be available for use as well. The memory 630 can include multiple different types of memory with different performance characteristics. It can be appreciated that the disclosure may operate on a computing device 600 with more than one processor 620 or on a group or cluster of computing devices networked together to provide greater processing capability. The processor 620 can include any general purpose processor and a hardware module or software module, such as module 1 662, module 2 664, and module 3 666 stored in storage device 660, configured to control the processor 620 as well as a special-purpose processor where software instructions are incorporated into the actual processor design. The processor 620 may essentially be a completely self-contained computing system, containing multiple cores or processors, a bus, memory controller, cache, etc. A multi-core processor may be symmetric or asymmetric.

The system bus 610 may be any of several types of bus structures including a memory bus or memory controller, a peripheral bus, and a local bus using any of a variety of bus architectures. A basic input/output (BIOS) stored in ROM 640 or the like, may provide the basic routine that helps to transfer information between elements within the computing device 600, such as during start-up. The computing device 600 further includes storage devices 660 such as a hard disk drive, a magnetic disk drive, an optical disk drive, tape drive or the like. The storage device 660 can include software modules 662, 664, 666 for controlling the processor 620. Other hardware or software modules are contemplated. The storage device 660 is connected to the system bus 610 by a drive interface. The drives and the associated computer-readable storage media provide nonvolatile storage of computer-readable instructions, data structures, program modules and other data for the computing device 600. In one aspect, a hardware module that performs a particular function includes the software component stored in a tangible computer-readable storage medium in connection with the necessary hardware components, such as the processor 620, bus 610, display 670, and so forth, to carry out the function. In another aspect, the system can use a processor and computer-readable storage medium to store instructions which, when executed by the processor, cause the processor to perform a method or other specific actions. The basic components and appropriate variations are contemplated depending on the type of device, such as whether the device 600 is a small, handheld computing device, a desktop computer, or a computer server.

Although the exemplary embodiment described herein employs the hard disk 660, other types of computer-readable media which can store data that are accessible by a computer, such as magnetic cassettes, flash memory cards, digital versatile disks, cartridges, random access memories (RAMs) 650, and read-only memory (ROM) 640, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with the computing device 600, an input device 690 represents any number of input mechanisms, such as a microphone for speech, a touch-sensitive screen for gesture or graphical input, keyboard, mouse, motion input, speech and so forth. An output device 670 can also be one or more of a number of output mechanisms known to those of skill in the art. In some instances, multimodal systems enable a user to provide multiple types of input to communicate with the computing device 600. The communications interface 680 generally governs and manages the user input and system output. There is no restriction on operating on any particular hardware arrangement and therefore the basic features here may easily be substituted for improved hardware or firmware arrangements as they are developed.

Use of language such as "at least one of X, Y, and Z" or "at least one or more of X, Y, or Z" are intended to convey a single item (just X, or just Y, or just Z) or multiple items (i.e., {X and Y}, {Y and Z}, or {X, Y, and Z}). "At least one of" is not intended to convey a requirement that each possible item must be present.

The various embodiments described above are provided by way of illustration only and should not be construed to limit the scope of the disclosure. Various modifications and changes may be made to the principles described herein without following the example embodiments and applications illustrated and described herein, and without departing from the spirit and scope of the disclosure.

We claim:

1. A method comprising:

receiving, at a processor associated with a storage space, order information from a remote computing device;

generating, via the processor and based on the order information, single-use access information for opening the storage space to perform an action, the action comprising one of depositing of an item associated with the order information into the storage space and retrieving the item associated with the order information from the storage space;

encoding the single-use access information into a token, the token having a layer of encryption;

receiving a photograph of an exterior of the storage space from a mobile device;

after receiving the photograph, transmitting a location of the storage space to the mobile device associated with performance of the action;

identifying a geo-fence area surrounding the storage space;

receiving, from the mobile device, a notification that the mobile device has entered the geo-fence area;

transmitting, in response to receiving the notification, the token to the mobile device;

after transmitting the token, receiving the single-use access information; and providing access to the storage space based on receiving the single-use access information.

2. The method of claim 1, wherein the action is performed by an automated vehicle, and the mobile device is a component of the automated vehicle.

3. The method of claim 1, wherein the action is performed by a human being, and the mobile device is associated with the human being.

4. The method of claim 1, wherein the layer of encryption comprises:

encoding the single-use access information into a block associated with a blockchain; and transmitting the block to a distributing computing system which:

(1) verifies the block as valid, (2) adds the block to the blockchain, and (3) distributes an updated blockchain containing the block throughout the distributed computing system.

5. The method of claim 1, further comprising displaying, on the exterior of the storage space, a time-sensitive randomized code.

6. The method of claim 1, wherein the receiving of the notification that the mobile device has entered the geo-fence area is performed using a near-field communication system.

7. The method of claim 1, wherein the notification that the mobile device has entered the geo-fence area comprises Global Positioning System coordinates of the mobile device.

8. The method of claim 1, further comprising:

identifying an identification of the item based on a Radio Frequency Identification tag associated with the item.

9. The method of claim 8, wherein as the action is performed, movement of the Radio Frequency Identification tag associated with the item is registered with the processor.

10. A storage space comprising:

a processor; and a computer-readable storage medium having instructions stored which, when executed by the processor, cause the processor to perform operations comprising:

receiving order information from a remote computing device;

generating, based on the order information, single-use access information for opening the storage space to perform an action, the action comprising one of depositing of an item associated with the order information into the storage space and retrieving the item associated with the order information from the storage space;

encoding the single-use access information into a token, the token having a layer of encryption;

receiving a photograph of an exterior of the storage space from a mobile device;

after receiving the photograph, transmitting a location of the storage space to the mobile device associated with performance of the action;

identifying a geo-fence area surrounding the storage space;

receiving, from the mobile device, a notification that the mobile device has entered the geo-fence area;

transmitting, in response to receiving the notification, the token to the mobile device;

after transmitting the token, receiving the single-use access information; and providing access to the storage space based on receiving the single-use access information.

11. The storage space of claim 10, wherein the action is performed by an automated vehicle, and the mobile device is a component of the automated vehicle.

12. The storage space of claim 10, wherein the action is performed by a human being, and the mobile device is associated with the human being.

13. The storage space of claim 10, wherein the layer of encryption comprises:

encoding the single-use access information into a block associated with a blockchain; and transmitting the block to a distributing computing system which:

(1) verifies the block as valid, (2) adds the block to the blockchain, and (3) distributes an updated blockchain containing the block throughout the distributed computing system.

14. The storage space of claim 10, the computer-readable storage medium having additional instructions stored which, when executed by the processor, cause the processor to perform operations comprising:

displaying, on the exterior of the storage space, a time-sensitive randomized code.

15. The storage space of claim 10, wherein the receiving of the notification that the mobile device has entered the geo-fence area is performed using a near-field communication system.

16. The storage space of claim 10, wherein the notification that the mobile device has entered the geo-fence area comprises Global Positioning System coordinates of the mobile device.

17. The storage space of claim 10, the computer-readable storage medium having additional instructions stored which, when executed by the processor, cause the processor to perform operations comprising:

identifying an identification of the item based on a Radio Frequency Identification tag associated with the item.

18. A non-transitory computer-readable storage medium having instructions stored which, when executed by a computing device, cause the computing device to perform operations comprising:

receiving order information from a remote computing device;

generating, based on the order information, single-use access information for opening the storage space to perform an action, the action comprising one of depositing of an item associated with the order information into the storage space and retrieving the item associated with the order information from the storage space;

encoding the single-use access information into a token, the token having a layer of encryption;

receiving a photograph of an exterior of the storage space from a mobile device;

after receiving the photograph, transmitting a location of the storage space to the mobile device associated with performance of the action;

identifying a geo-fence area surrounding the storage space;

receiving, from the mobile device, a notification that the mobile device has entered the geo-fence area;

transmitting, in response to receiving the notification, the token to the mobile device;

after transmitting the token, receiving the single-use access information; and providing access to the storage space based on receiving the single-use access information.

* * * * *